US010469944B2

(12) United States Patent
Niemisto et al.

(10) Patent No.: US 10,469,944 B2
(45) Date of Patent: Nov. 5, 2019

(54) NOISE REDUCTION IN MULTI-MICROPHONE SYSTEMS

(71) Applicant: Nokia Technologies Oy, Espoo (FI)

(72) Inventors: Riitta Niemisto, Tampere (FI); Ville Myllyla, Tampere (FI)

(73) Assignee: Nokia Technologies Oy, Espoo (FI)

( * ) Notice: Subject to any disclaimer, the term of this patent is extended or adjusted under 35 U.S.C. 154(b) by 129 days.

(21) Appl. No.: 14/515,917

(22) Filed: Oct. 16, 2014

(65) Prior Publication Data

US 2015/0110284 A1 Apr. 23, 2015

(30) Foreign Application Priority Data

Oct. 21, 2013 (GB) ..... 1318597.0

(51) Int. Cl.
*H04R 3/00* (2006.01)
*H04R 1/08* (2006.01)
(Continued)

(52) U.S. Cl.
CPC ..... *H04R 3/002* (2013.01); *G10L 21/0208* (2013.01); *H04R 1/08* (2013.01); *G10L 2021/02166* (2013.01); *H04R 2410/01* (2013.01)

(58) Field of Classification Search
CPC ..... H04R 3/002; H04R 2410/01; H04R 1/08; G10L 21/0208; G10L 2021/02166
(Continued)

(56) References Cited

U.S. PATENT DOCUMENTS 8,244,528 B2 8/2012 Niemisto et al.
8,275,136 B2 9/2012 Niemisto et al.
(Continued)

FOREIGN PATENT DOCUMENTS

GB 2446619 A 8/2008
WO 2001/037265 A1 5/2001
(Continued)

OTHER PUBLICATIONS

Extended European Search Report received for corresponding European Patent Application No. 14188582.2, dated Apr. 1, 2015, 4 pages.
(Continued)

*Primary Examiner* — Vivian C Chin
*Assistant Examiner* — Douglas J Suthers
(74) *Attorney, Agent, or Firm* — Harrington & Smith

(57) ABSTRACT

An apparatus comprising: an input configured to receive at least three microphone audio signals, the at least three microphone audio signals comprising at least two near microphone audio signals generated by at least two near microphones located near to an desired audio source and at least one farmic audio signal generated by a farmic located further from the desired audio source; a first interference canceller module configured to generate a first processed audio signal based on a first selection from the near microphone audio signals; at least one further interference canceller module configured to generate at least one further processed audio signal based on at least one further selection from the at least three microphone audio signals; a comparator configured to determine from the first processed audio signal and the at least one further processed audio signal the audio signal with greater noise suppression.

24 Claims, 7 Drawing Sheets

(51) Int. Cl.
*G10L 21/0208* (2013.01)
*G10L 21/0216* (2013.01)

(58) Field of Classification Search
USPC ..... 381/71.1, 92, 334
See application file for complete search history.

(56) References Cited

U.S. PATENT DOCUMENTS

| | | | | |
|---|---|---|---|---|
| 2005/0147258 | A1 | 7/2005 | Myllyla et al. | |
| 2005/0195990 | A1* | 9/2005 | Kondo | G10L 21/0272 381/92 |
| 2006/0053007 | A1 | 3/2006 | Niemisto | |
| 2009/0198495 | A1 | 8/2009 | Hata | |
| 2010/0046770 | A1 | 2/2010 | Chan et al. | |
| 2010/0081487 | A1 | 4/2010 | Chen et al. | |
| 2010/0215199 | A1* | 8/2010 | Breebaart | H04S 5/005 381/310 |
| 2010/0290629 | A1* | 11/2010 | Morii | G10L 19/008 381/2 |
| 2011/0182436 | A1 | 7/2011 | Murgia et al. | |
| 2012/0051548 | A1 | 3/2012 | Visser et al. | |
| 2012/0230511 | A1 | 9/2012 | Burnett | |
| 2013/0082875 | A1 | 4/2013 | Sorensen | |

FOREIGN PATENT DOCUMENTS

| | | | |
|---|---|---|---|
| WO | 2011/103488 | A1 | 8/2011 |
| WO | 2012/020394 | A2 | 2/2012 |

OTHER PUBLICATIONS

Widrow et al., "Adaptive Noise Cancelling: Principles and applications", Proceedings of the IEEE, vol. 63, Issue: 12, Dec. 1975, pp. 1692-1716.

"Three Microphones Noise Reduction Bluetooth Stereo Headset", Aliexpress, Retrieved on Oct. 8, 2013, Webpage available at : http://www.aliexpress.com/item/Free-Shipping-Class-2-V2-1-EDR-Cannice-Three-Microphones-Noise-Reduction-Bluetooth-Stereo-Headset-595866482.html.

"Moto X Review", Anandtech, Retrieved on Dec. 17, 2014, Webpage available at : http://www.anandtech.com/show/7235/moto-x-review.

Search Report received for corresponding United Kingdom Patent Application No. 1318597.0, dated Dec. 18, 2013, 3 pages.

* cited by examiner

NOISE REDUCTION IN MULTI-MICROPHONE SYSTEMS

FIELD

The present application relates to apparatus and methods for the implementation of noise reduction or audio enhancement in multi-microphone systems and specifically but not only implementation of noise reduction or audio enhancement in multi-microphone systems within mobile apparatus.

BACKGROUND

Audio recording systems can make use of more than one microphone to pick-up and record audio in the surrounding environment.

These multi-microphone systems (or MMic systems) permit the implementation of digital signal processing such as speech enhancement to be applied to the microphone outputs. The intention in speech enhancement is to use mathematical methods to improve the quality of speech, presented as digital signals. One speech enhancement implementation is concerned with uplink processing the audio signals from three inputs or microphones.

SUMMARY

According to a first aspect there is provided a method comprising: receiving at least three microphone audio signals, the at least three microphone audio signals comprising at least two near microphone audio signals generated by at least two near microphones located near to an desired audio source and at least one far microphone audio signal generated by a far microphone located further from the desired audio source than the at least two near microphones; generating a first processed audio signal based on a first selection from the at least three microphone audio signals, the first selection being from the near microphone audio signals; generating at least one further processed audio signal based on at least one further selection from the at least three microphone audio signals, the at least one further selection from the at least three microphone audio signals, the second selection being from all of the microphone signals; determining from the first processed audio signal and the at least one further processed audio signal the audio signal with greater noise suppression.

The greater noise suppression may comprise improved noise suppression.

Receiving at least three microphone audio signals may comprise: receiving a first microphone audio signal from a first near microphone located substantially at a front of an apparatus; receiving a second microphone audio signal from a second near microphone located substantially at a rear of the apparatus; and receiving a third microphone audio signal from a far microphone located substantially at the opposite end from the first and second microphones.

Generating a first processed audio signal based on a first selection from the at least three microphone audio signals may comprise generating a first processed audio signal based on a main beam audio signal based on the first and second microphone audio signals and an anti-beam audio signal based on the first and second microphone audio signals.

Generating at least one further processed audio signal based on at least one further selection from the at least three microphone audio signals comprises generating a further processed audio signal based on a main beam audio signal based on the first and second microphone audio signals and the third microphone audio signal.

The method may further comprise: generating a main beam audio signal by: applying a first finite impulse response filter to the first audio signal; applying a second finite impulse response filter to the second audio signal; and combining the output of the first impulse response filter and the second finite response filter to generate the main beam audio signal; and generating an anti-beam audio signal by: applying a third finite impulse response filter to the first audio signal; applying a fourth finite impulse response filter to the second audio signal; and combining the output of the third impulse response filter and the fourth finite response filter to generate the anti-beam audio signal.

Generating a further processed audio signal based on a main beam audio signal based on the first and second microphone audio signals and the third microphone audio signal may comprise filtering the main beam audio signal based on the third microphone audio signal.

Generating a first processed audio signal based on a main beam audio signal based on the first and second microphone audio signals and an anti-beam audio signal based on the first and second microphone audio signals may comprise filtering the main beam audio signal based on the anti-beam audio signal.

Generating a first processed audio signal based on a first selection from the at least three microphone audio signals may comprise: selecting as a first processing input at least one of: one of the at least three microphone audio signals; and a beamformed audio signal based on at least two of the at least three microphone audio signals, the selections being from the near microphone audio signals; selecting as a second processing input at least one of: one of the at least three microphone audio signals; and a beamformed audio signal based on the at least three microphone audio signals, the selections being from the near microphone audio signals; filtering the first processing input based on the second processing input to generate the first processed audio signal.

Generating at least one further processed audio signal based on at least one further selection from the at least three microphone audio signals may comprise: selecting as a first processing input at least one of: one of the at least three microphone audio signals; and a beamformed audio signal based on at least two of the at least three microphone audio signals, the selections being from all of the microphone signals; selecting as a second processing input at least one of: one of the at least three microphone audio signals; and a beamformed audio signal based on at least two of the at least three microphone audio signals, the selections being from all of the microphone signals; filtering the first processing input based on the second processing input to generate the at least one further processed audio signal.

Filtering the first processing input based on the second processing input to generate the at least one further processed audio signal may comprise noise suppression filtering the first processing input based on the second processing input.

The method may further comprise beamforming at least two of the at least three microphone audio signals to generate a beamformed audio signal.

Beamforming at least two of the at least three microphone audio signals to generate a beamformed audio signal may comprise: applying a first finite impulse response filter to a first of the at least two of the at least three microphone audio signals; applying a second finite impulse response filter to a second of the at least two of the at least three microphone audio signals; and combining the output of the first impulse response filter and the second finite response filter to generate the beamformed audio signal.

The method may further comprise single channel noise suppressing the audio signal with greater noise suppression, wherein single channel noise suppressing comprises:

generating an indicator showing whether a period of the audio signal comprises a lack of speech components or is significantly noise; estimating and updating a background noise from the audio signal when the indicator shows the period of the audio signal comprises a lack of speech components or is significantly noise; processing the audio signal based on the background noise estimate to generate a noise suppressed audio signal.

Generating an indicator showing whether a period of the audio signal comprises a lack of speech components or is significantly noise may comprise: normalising a selection from the at least three microphone audio signals, wherein the selection comprises: beamformed audio signals of at least two of the at least three microphone audio signals; and microphone audio signals; filtering the normalised selections from the at least three microphone audio signals; comparing the filtered normalised selections to determine a power difference ratio; generating the indicator showing a period of the audio signal comprises a lack of speech components or is significantly noise where at least one comparison of filtered normalised selections has a power difference ratio greater than a determined threshold.

Determining from the first processed audio signal and the at least one further processed audio signal the audio signal with greater noise suppression may comprise at least one of: determining from the first processed audio signal and the at least one further processed audio signal the audio signal with the highest signal level output; and determining from the first processed audio signal and the at least one further processed audio signal the audio signal with the highest power level output.

According to a second aspect there is provided an apparatus comprising at least one processor and at least one memory including computer code for one or more programs, the at least one memory and the computer code configured to with the at least one processor cause the apparatus to: receive at least three microphone audio signals, the at least three microphone audio signals comprising at least two near microphone audio signals generated by at least two near microphones located near to an desired audio source and at least one far microphone audio signal generated by a far microphone located further from the desired audio source than the at least two near microphones; generate a first processed audio signal based on a first selection from the at least three microphone audio signals, the first selection being from the near microphone audio signals; generate at least one further processed audio signal based on at least one further selection from the at least three microphone audio signals, the at least one further selection from the at least three microphone audio signals, the second selection being from all of the microphone signals; determine from the first processed audio signal and the at least one further processed audio signal the audio signal with greater noise suppression.

Receiving at least three microphone audio signals may cause the apparatus to: receive a first microphone audio signal from a first near microphone located substantially at a front of an apparatus; receive a second microphone audio signal from a second near microphone located substantially at a rear of the apparatus; and receive a third microphone audio signal from a far microphone located substantially at the opposite end from the first and second microphones.

Generating a first processed audio signal based on a first selection from the at least three microphone audio signals may cause the apparatus to generate a first processed audio signal based on a main beam audio signal based on the first and second microphone audio signals and an anti-beam audio signal based on the first and second microphone audio signals.

Generating at least one further processed audio signal based on at least one further selection from the at least three microphone audio signals may cause the apparatus to generate a further processed audio signal based on a main beam audio signal based on the first and second microphone audio signals and the third microphone audio signal.

The apparatus may be further caused to: generate a main beam audio signal by applying a first finite impulse response filter to the first audio signal; applying a second finite impulse response filter to the second audio signal; and combining the output of the first impulse response filter and the second finite response filter to generate the main beam audio signal; and generate an anti-beam audio signal by: applying a third finite impulse response filter to the first audio signal; applying a fourth finite impulse response filter to the second audio signal; and combining the output of the third impulse response filter and the fourth finite response filter to generate the anti-beam audio signal.

Generating a further processed audio signal based on a main beam audio signal based on the first and second microphone audio signals and the third microphone audio signal may cause the apparatus to filter the main beam audio signal based on the third microphone audio signal.

Generating a first processed audio signal based on a main beam audio signal based on the first and second microphone audio signals and an anti-beam audio signal based on the first and second microphone audio signals may cause the apparatus to filter the main beam audio signal based on the anti-beam audio signal.

Generating a first processed audio signal based on a first selection from the at least three microphone audio signals may cause the apparatus to: select as a first processing input at least one of: one of the at least three microphone audio signals; and a beamformed audio signal based on at least two of the at least three microphone audio signals, the selections being from the near microphone audio signals; select as a second processing input at least one of: one of the at least three microphone audio signals; and a beamformed audio signal based on the at least three microphone audio signals, the selections being from the near microphone audio signals; filter the first processing input based on the second processing input to generate the first processed audio signal.

Generating at least one further processed audio signal based on at least one further selection from the at least three microphone audio signals may cause the apparatus to: select as a first processing input at least one of: one of the at least three microphone audio signals; and a beamformed audio signal based on at least two of the at least three microphone audio signals, the selections being from all of the microphone signals; select as a second processing input at least one of: one of the at least three microphone audio signals; and a beamformed audio signal based on at least two of the at least three microphone audio signals, the selections being from all of the microphone signals;

filter the first processing input based on the second processing input to generate the at least one further processed audio signal.

Filtering the first processing input based on the second processing input to generate the at least one further processed audio signal may cause the apparatus to noise suppression filter the first processing input based on the second processing input.

The apparatus may be caused to beamform at least two of the at least three microphone audio signals to generate a beamformed audio signal.

Beamforming at least two of the at least three microphone audio signals to generate a beamformed audio signal may cause the apparatus to: apply a first finite impulse response filter to a first of the at least two of the at least three microphone audio signals; apply a second finite impulse response filter to a second of the at least two of the at least three microphone audio signals; and combine the output of the first impulse response filter and the second finite response filter to generate the beamformed audio signal.

The apparatus may be caused to single channel noise suppress the audio signal with greater noise suppression, wherein single channel noise suppressing may cause the apparatus to: generate an indicator showing whether a period of the audio signal comprises a lack of speech components or is significantly noise; estimate and update a background noise from the audio signal when the indicator shows the period of the audio signal comprises a lack of speech components or is significantly noise; process the audio signal based on the background noise estimate to generate a noise suppressed audio signal.

Generating an indicator showing whether a period of the audio signal comprises a lack of speech components or is significantly noise may cause the apparatus to: normalise a selection from the at least three microphone audio signals, wherein the selection comprises: beamformed audio signals of at least two of the at least three microphone audio signals; and microphone audio signals; filter the normalised selections from the at least three microphone audio signals; compare the filtered normalised selections to determine a power difference ratio; generate the indicator showing a period of the audio signal comprises a lack of speech components or is significantly noise where at least one comparison of filtered normalised selections has a power difference ratio greater than a determined threshold.

Determining from the first processed audio signal and the at least one further processed audio signal the audio signal with greater noise suppression may cause the apparatus to perform at least one of: determine from the first processed audio signal and the at least one further processed audio signal the audio signal with the highest signal level output; and determine from the first processed audio signal and the at least one further processed audio signal the audio signal with the highest power level output.

According to a third aspect there is provided an apparatus comprising: an input configured to receive at least three microphone audio signals, the at least three microphone audio signals comprising at least two near microphone audio signals generated by at least two near microphones located near to an desired audio source and at least one far microphone audio signal generated by a far microphone located further from the desired audio source than the at least two near microphones; a first interference canceller module configured to generate a first processed audio signal based on a first selection from the at least three microphone audio signals, the first selection being from the near microphone audio signals; at least one further interference canceller module configured to generate at least one further processed audio signal based on at least one further selection from the at least three microphone audio signals, the at least one further selection from the at least three microphone audio signals, the second selection being from all of the microphone signals; a comparator configured to determine from the first processed audio signal and the at least one further processed audio signal the audio signal with greater noise suppression.

The input may be configured to: receive a first microphone audio signal from a first near microphone located substantially at a front of an apparatus; receive a second microphone audio signal from a second near microphone located substantially at a rear of the apparatus; and receive a third microphone audio signal from a far microphone located substantially at the opposite end from the first and second microphones.

The first interference canceller module may be configured to generate a first processed audio signal based on a main beam audio signal based on the first and second microphone audio signals and an anti-beam audio signal based on the first and second microphone audio signals.

The at least one further interference canceller module may be configured to generate a further processed audio signal based on a main beam audio signal based on the first and second microphone audio signals and the third microphone audio signal.

The apparatus may further comprise: a main beam beamformer configured to generate a main beam audio signal comprising a first finite impulse response filter configured to receive the first audio signal; a second finite impulse response filter configured to receive the second audio signal; and a combiner configured to combine the output of the first impulse response filter and the second finite response filter to generate the main beam audio signal; and an anti-beam beamformer configured to generate an anti-beam audio signal comprising: a third finite impulse response filter configured to receive the first audio signal; a fourth finite impulse response filter configured to receive the second audio signal; and a combiner configured to combine the output of the third impulse response filter and the fourth finite response filter to generate the anti-beam audio signal.

The at least one further interference canceller module may comprise a filter configured to filter the main beam audio signal based on the third microphone audio signal.

The first interference canceller module may comprise a filter configured to filter the main beam audio signal based on the anti-beam audio signal.

The first interference canceller module may comprise: a selector configured to select as a first processing input at least one of: one of the at least three microphone audio signals; and a beamformed audio signal based on at least two of the at least three microphone audio signals, the selections being from the near microphone audio signals; a second selector configured to select as a second processing input at least one of: one of the at least three microphone audio signals; and a beamformed audio signal based on the at least three microphone audio signals, the selections being from the near microphone audio signals; a filter configured to filter the first processing input based on the second processing input to generate the first processed audio signal.

The at least one further interference generator may comprise: a selector configured to select as a first processing input at least one of: one of the at least three microphone audio signals; and a beamformed audio signal based on at least two of the at least three microphone audio signals, the selections being from all of the microphone signals; a second selector configured to select as a second processing input at least one of: one of the at least three microphone audio signals; and a beamformed audio signal based on at least two of the at least three microphone audio signals, the selections being from all of the microphone signals; a filter configured to filter the first processing input based on the second processing input to generate the at least one further processed audio signal.

The filter may be configured to noise suppression filter the first processing input based on the second processing input.

The apparatus may comprise a beamformer configured to beamform at least two of the at least three microphone audio signals to generate a beamformed audio signal.

The beamformer may comprise: a first finite impulse response filter configured to filter a first of the at least two of the at least three microphone audio signals; a second finite response filter configured to filter to a second of the at least two of the at least three microphone audio signals; and a combiner configured to combine the output of the first impulse response filter and the second finite response filter to generate the beamformed audio signal.

The apparatus may comprise a single channel noise suppressor configured to noise suppress the audio signal with greater noise suppression, the single channel noise suppressor may comprise: an input configured to receive an indicator showing whether a period of the audio signal comprises a lack of speech components or is significantly noise; an estimator configured to estimate and update a background noise from the audio signal when the indicator shows the period of the audio signal comprises a lack of speech components or is significantly noise; a filter configured to process the audio signal with greater noise suppression based on the background noise estimate to generate a noise suppressed audio signal.

The apparatus may comprise a voice activity detector configured to generate an indicator showing whether a period of the audio signal comprises a lack of speech components or is significantly noise comprising: a normaliser configured to normalise a selection from the at least three microphone audio signals, wherein the selection comprises: beamformed audio signals of at least two of the at least three microphone audio signals; and microphone audio signals; a filter configured to filter the normalised selections from the at least three microphone audio signals; a comparator configured to compare the filtered normalised selections to determine a power difference ratio; an indicator generator configured to generate the indicator showing a period of the audio signal with greater noise suppression comprises a lack of speech components or is significantly noise where at least one comparison of filtered normalised selections has a power difference ratio greater than a determined threshold.

The comparator configured to determine from the first processed audio signal and the at least one further processed audio signal the audio signal with greater noise suppression may be configured to perform at least one of: determine from the first processed audio signal and the at least one further processed audio signal the audio signal with the highest signal level output; and determine from the first processed audio signal and the at least one further processed audio signal the audio signal with the highest power level output.

According to a fourth aspect there is provided an apparatus comprising: means for receiving at least three microphone audio signals, the at least three microphone audio signals comprising at least two near microphone audio signals generated by at least two near microphones located near to an desired audio source and at least one far microphone audio signal generated by a far microphone located further from the desired audio source than the at least two near microphones; means for generating a first processed audio signal based on a first selection from the at least three microphone audio signals, the first selection being from the near microphone audio signals; means for generating at least one further processed audio signal based on at least one further selection from the at least three microphone audio signals, the at least one further selection from the at least three microphone audio signals, the second selection being from all of the microphone signals; means for determining from the first processed audio signal and the at least one further processed audio signal the audio signal with greater noise suppression.

The means for receiving at least three microphone audio signals may comprise: means for receiving a first microphone audio signal from a first near microphone located substantially at a front of an apparatus; means for receiving a second microphone audio signal from a second near microphone located substantially at a rear of the apparatus; and means for receiving a third microphone audio signal from a far microphone located substantially at the opposite end from the first and second microphones.

The means for generating a first processed audio signal based on a first selection from the at least three microphone audio signals may comprise means for generating a first processed audio signal based on a main beam audio signal based on the first and second microphone audio signals and an anti-beam audio signal based on the first and second microphone audio signals.

The means for generating at least one further processed audio signal based on at least one further selection from the at least three microphone audio signals may comprise means for generating a further processed audio signal based on a main beam audio signal based on the first and second microphone audio signals and the third microphone audio signal.

The apparatus may further comprise: means for generating a main beam audio signal comprising: means for applying a first finite impulse response filter to the first audio signal; means for applying a second finite impulse response filter to the second audio signal; and means for combining the output of the first impulse response filter and the second finite response filter to generate the main beam audio signal; and means for generating an anti-beam audio signal may comprise: means for applying a third finite impulse response filter to the first audio signal; means for applying a fourth finite impulse response filter to the second audio signal; and means for combining the output of the third impulse response filter and the fourth finite response filter to generate the anti-beam audio signal.

The means for generating a further processed audio signal based on a main beam audio signal based on the first and second microphone audio signals and the third microphone audio signal may comprise means for filtering the main beam audio signal based on the third microphone audio signal.

The means for generating a first processed audio signal based on a main beam audio signal based on the first and second microphone audio signals and an anti-beam audio signal based on the first and second microphone audio signals may comprise means for filtering the main beam audio signal based on the anti-beam audio signal.

The means for generating a first processed audio signal based on a first selection from the at least three microphone audio signals may comprise: means for selecting as a first processing input at least one of: one of the at least three microphone audio signals; and a beamformed audio signal based on at least two of the at least three microphone audio signals, the selections being from the near microphone audio signals; means for selecting as a second processing input at least one of: one of the at least three microphone audio signals; and a beamformed audio signal based on the at least three microphone audio signals, the selections being from the near microphone audio signals; means for filtering the first processing input based on the second processing input to generate the first processed audio signal.

The means for generating at least one further processed audio signal based on at least one further selection from the at least three microphone audio signals may comprise: means for selecting as a first processing input at least one of: one of the at least three microphone audio signals; and a beamformed audio signal based on at least two of the at least three microphone audio signals, the selections being from all of the microphone signals; means for selecting as a second processing input at least one of: one of the at least three microphone audio signals; and a beamformed audio signal based on at least two of the at least three microphone audio signals, the selections being from all of the microphone signals; means for filtering the first processing input based on the second processing input to generate the at least one further processed audio signal.

The means for filtering the first processing input based on the second processing input to generate the at least one further processed audio signal comprises noise suppression filtering the first processing input based on the second processing input.

The apparatus may further comprise means for beamforming at least two of the at least three microphone audio signals to generate a beamformed audio signal.

The means for beamforming at least two of the at least three microphone audio signals to generate a beamformed audio signal may comprise: means for applying a first finite impulse response filter to a first of the at least two of the at least three microphone audio signals; means for applying a second finite impulse response filter to a second of the at least two of the at least three microphone audio signals; and means for combining the output of the first impulse response filter and the second finite response filter to generate the beamformed audio signal.

The apparatus may further comprise means for single channel noise suppressing the audio signal with greater noise suppression, wherein the means for single channel noise suppressing may comprise: means for generating an indicator showing whether a period of the audio signal comprises a lack of speech components or is significantly noise; means for estimating and updating a background noise from the audio signal when the indicator shows the period of the audio signal comprises a lack of speech components or is significantly noise; means for processing the audio signal based on the background noise estimate to generate a noise suppressed audio signal.

The means for generating an indicator showing whether a period of the audio signal comprises a lack of speech components or is significantly noise may comprise: means for normalising a selection from the at least three microphone audio signals, wherein the selection comprises: beamformed audio signals of at least two of the at least three microphone audio signals; and microphone audio signals; means for filtering the normalised selections from the at least three microphone audio signals; means for comparing the filtered normalised selections to determine a power difference ratio; means for generating the indicator showing a period of the audio signal comprises a lack of speech components or is significantly noise where at least one comparison of filtered normalised selections has a power difference ratio greater than a determined threshold.

The means for determining from the first processed audio signal and the at least one further processed audio signal the audio signal with greater noise suppression comprises at least one of: means for determining from the first processed audio signal and the at least one further processed audio signal the audio signal with the highest signal level output; and means for determining from the first processed audio signal and the at least one further processed audio signal the audio signal with the highest power level output.

Embodiments of the present application aim to address problems associated with the state of the art.

SUMMARY OF THE FIGURES

For better understanding of the present application, reference will now be made by way of example to the accompanying drawings in which.

EMBODIMENTS

Figure 2:
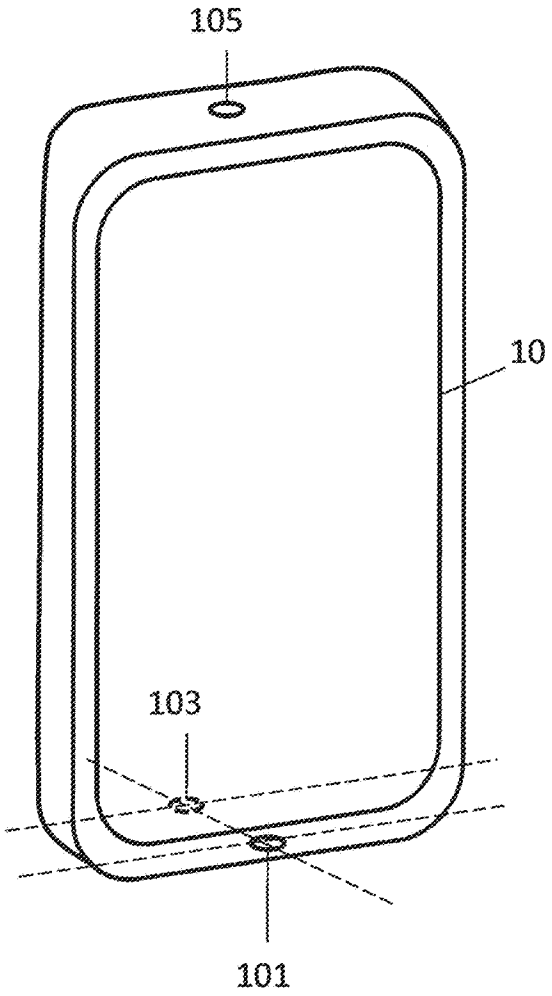
FIG. 2 shows schematically an example of a three microphone apparatus suitable for being employed in some embodiments.

The following describes in further detail suitable apparatus and possible mechanisms for the provision of the signal processing within multi-microphone systems. Some digital signal processing speech enhancement implementations use three microphone signals (from the available number of microphones on the apparatus or coupled to the apparatus). Two of the microphones or input signals originate from 'nearmics', (in other words microphones that are located close to each other such as at the bottom of the device) and a third microphone, 'farmic', located further away in the other end of the apparatus or device. An example of such an apparatus 10 is shown in FIG. 2 which shows the apparatus with a first microphone (mic1) 101, a front 'nearmic', located towards the bottom of the apparatus and facing the display or front of the apparatus, a second microphone (mic2) 103, a rear 'nearmic', shown by the dashed oval and located towards the bottom of the apparatus and on the opposite face to the display (or otherwise on the rear of the apparatus) and a third microphone (mic3) 105, a 'farmic', located on the 'top' of the apparatus 10. Although the following examples are described with respect to a 3 microphone system configuration it would be understood that in some embodiments the system can comprise more than 3 microphones from which a suitable selection of 3 microphones can be made.

Figure 5:
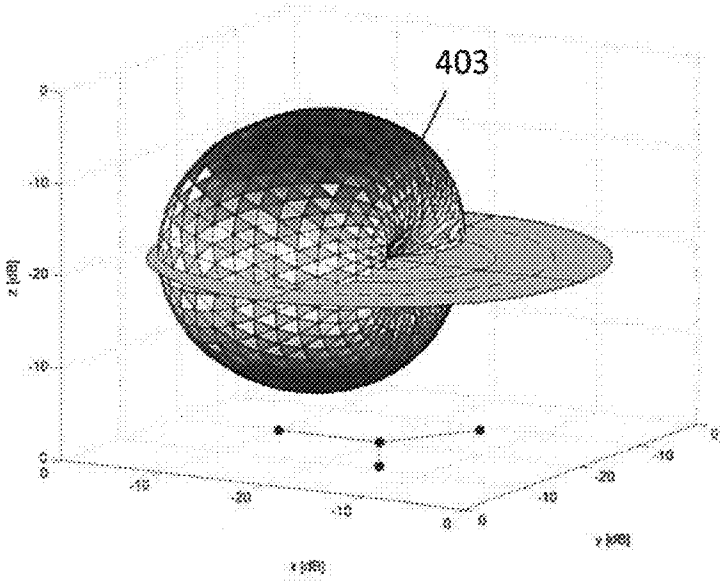
FIG. 5 shows schematically example gain diagrams of the mainbeam and antibeam audio signal beams according to some embodiments.
Figure 5:
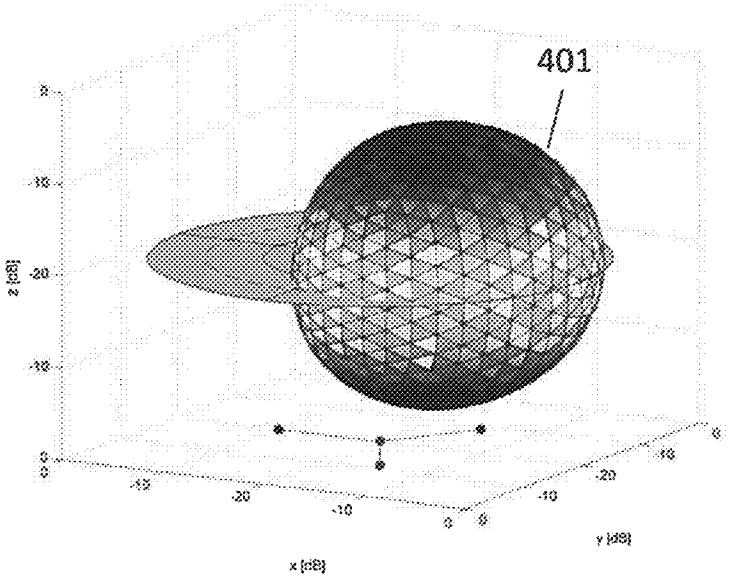

With two or more nearmics it is possible to form two directional beams from the audio signals generated from the microphones. These can for example as shown in FIG. 5 be a 'mainbeam' 401 and 'antibeam' 403. In the 'mainbeam' local speech is substantially passed while noise coming from opposite direction is significantly attenuated. In the 'antibeam' local speech is substantially attenuated while noise from other directions is substantially passed. In such situations the level of ambient noise is almost the same in both beams.

These beams (the main- and antibeams) can in some embodiments be used in further digital signal processing to further reduce remaining background noise from the main beam audio signal using an adaptive interference canceller (AIC) and spectral subtraction.

The adaptive interference canceller (AIC) with two near microphone audio signals can perform a first method to further cancel noise from the main beam. Although with one nearmic audio signal and one farmic audio signal beamforming is not possible, AIC can be used with microphone signals directly. Furthermore noise can be further reduced using spectral subtraction.

The first method using beam forming of the microphone audio signals to reduce noise is understood to provide efficient noise reductions, but it is sensitive to how the device is held. The second method using direct microphone audio signals is more orientation robust, but does not provide as efficient a noise reduction.

In both methods a spatial voice activity detector (VAD) can be used to improve noise suppression compared to single channel case with no directional information available. Spatial VADs can for example be combined with other VADs in signal processing and the background noise estimate can be updated when the voice activity detector determines that the audio signal does not contain voiced components. In other words the background noise estimate can be updated when the VAD method flags noise. An example of non-spatial voice activity detection to improve noise suppression is shown in U.S. Pat. No. 8,244,528.

In the case of the beamforming audio signal method, the spatial VAD output is typically the ratio between the determined or estimated main beam and the anti-beam powers. In the case of the direct microphone audio signal method, the spatial VAD output is typically the ratio between the input signals.

In such situations therefore the spatial VAD and AIC are both sensitive to the positioning of the apparatus or device. For example when speech leaks to the anti-beam or second microphone, the adaptive interference canceller (AIC) or noise suppressor may consider it as noise and attenuate local speech. It is understood that the problem is more severe with beamforming audio signal methods but also exists with the direct microphone audio signal methods.

The inventive concept as described in embodiments herein implements audio signal processing employing a third or further microphone(s) and addressing the problem of providing noise reduction that is both efficient and orientation robust.

In such embodiments as described herein the third or further microphone(s) are employed in order to achieve efficient noise reduction despite of the position of the apparatus, for example a phone placed neighbouring or on the user's ear. In hand portable mode, the speaker is usually located close to user's own ear (otherwise the user cannot hear anything), but the microphone can be located far from user's mouth. In such circumstances where the noise reduction is not orientation robust the user at the other end may not hear anything.

As described herein and shown with respect to FIG. 2 the apparatus comprises at least three microphones, two 'nearmics' and a 'farmic'.

In the embodiments as described herein the directional robust concept is implemented by a signal processor comprising two audio interference cancelers (AICs) operating in parallel. The first, primary, or main AIC configured to receive the main beam and anti-beam signals as the inputs to the first or main AIC. The second or secondary AIC configured to receive the mainbeam and farmic signals as the inputs to the second or secondary AIC. Thus it would be understood that the second or secondary AIC is configured to receive information from all three microphones.

In such embodiments the output signal levels from the parallel AICs can be compared and where there is considerable difference (for example a default difference value of 2 dB) in output levels, the signal that has higher level is used as output.

A smaller difference in output levels can be explained by the different noise reduction capabilities of the two AICs while a larger difference would be indicative that the AIC attenuates local speech whose output signal level is lower. The exception to this would be when wind noise causes problems. In some embodiments therefore a wind noise detector can be employed and when the wind noise detector flags the detection of wind, the first or main AIC is used In the embodiments as described herein the spatial voice activity detector (VAD) can be configured to receive as an input four signals: the main microphone signal (or first nearmic), the farmic signal, the main beam signal and the anti-beam signal. These signals can then as described herein be normalized so that their stationary noise levels are substantially the same. This normalization is performed to remove the possibility of microphone variability because microphone signals may have different sensitivities. Then as shown in the embodiments as described herein the normalized signal levels are compared over predefined frequency ranges. These predefined or determined frequency ranges can be low or lower frequencies for the microphone signals and determined based on the beam design for the beam audio signals.

Where there is considerable difference between main beam and anti-beam level for the frequency region comparisons, or considerable differences between the main microphone and 'farmic' signal levels, or considerable differences between the main beam and 'farmic' signal levels then as described herein the spatial voice activity detector can be configured to output a suitable indicator such as a VAD spatial flag to indicate that a speech and background noise estimate used in noise suppression is not to be updated. However where the signal levels are the same (which as described herein is determined by the difference being below a determined threshold) in all these signal pairs then the recorded signal is most likely background noise (or that the positioning of the apparatus is very unusual) and background noise estimate can be updated.

In the following examples the apparatus are shown operating in hand portable mode (in other words the apparatus or phone is located on or near the ear or user generally). However in some circumstances the embodiments may be implemented while the user is operating the apparatus in a speakerphone mode (such as being placed away from the user but in a way that the user is still the loudest audio source in the environment).

Figure 1:
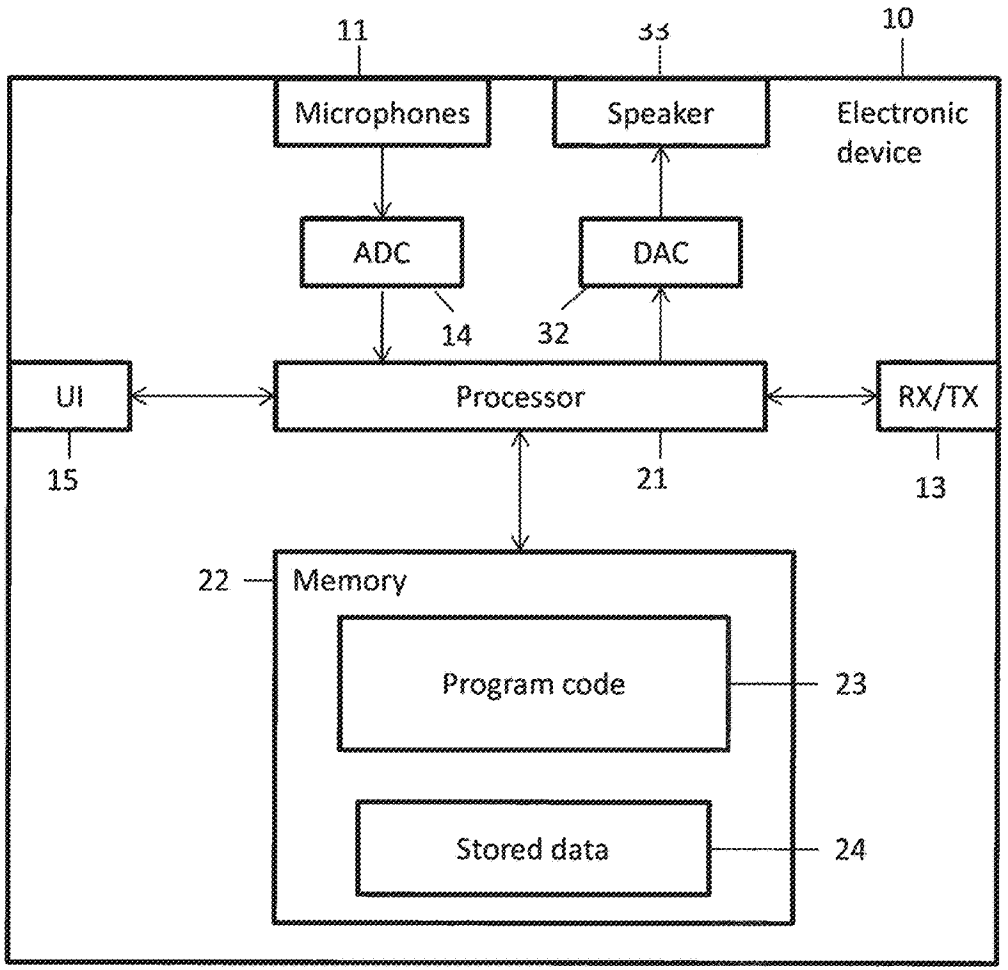
FIG. 1 shows schematically an apparatus suitable for being employed in some embodiments.

FIG. 1 shows an overview of a suitable system within which embodiments of the application can be implemented. FIG. 1 shows an example of an apparatus or electronic device 10. The apparatus 10 may be used to capture, record or listen to audio signals and may function as a capture apparatus.

The apparatus 10 may for example be a mobile terminal or user equipment of a wireless communication system when functioning as the audio capture or recording apparatus. In some embodiments the apparatus can be an audio recorder, such as an MP3 player, a media recorder/player (also known as an MP4 player), or any suitable portable apparatus suitable for recording audio or audio/video camcorder/memory audio or video recorder.

The apparatus 10 may in some embodiments comprise an audio subsystem. The audio subsystem for example can comprise in some embodiments at least three microphones or array of microphones 11 for audio signal capture. In some embodiments the at least three microphones or array of microphones can be a solid state microphone, in other words capable of capturing audio signals and outputting a suitable digital format signal. In some other embodiments the at least three microphones or array of microphones 11 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or micro electrical-mechanical system (MEMS) microphone. In some embodiments the microphones 11 are digital microphones, in other words configured to generate a digital signal output (and thus not requiring an analogue-to-digital converter). The microphones 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form. The analogue-to-digital converter 14 can be any suitable analogue-to-digital conversion or processing means. In some embodiments the microphones are 'integrated' microphones containing both audio signal generating and analogue-to-digital conversion capability.

In some embodiments the apparatus 10 audio subsystems further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio subsystem can comprise in some embodiments a speaker 33. The speaker 33 can in some embodiments receive the output from the digital-to-analogue converter 32 and present the analogue audio signal to the user. In some embodiments the speaker 33 can be representative of multi-speaker arrangement, a headset, for example a set of headphones, or cordless headphones.

Although the apparatus 10 is shown having both audio (speech) capture and audio presentation components, it would be understood that in some embodiments the apparatus 10 can comprise only the audio (speech) capture part of the audio subsystem such that in some embodiments of the apparatus the microphones (for speech capture) are present.

In some embodiments the apparatus 10 comprises a processor 21. The processor 21 is coupled to the audio subsystem and specifically in some examples the analogue-to-digital converter 14 for receiving digital signals representing audio signals from the microphone 11, and the digital-to-analogue converter (DAC) 12 configured to output processed digital audio signals. The processor 21 can be configured to execute various program codes. The implemented program codes can comprise for example audio recording and audio signal processing routines.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been recorded or analysed in accordance with the application. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15. The user interface 15 can in some embodiments comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling.

The coupling can be any suitable known communications protocol, for example in some embodiments the transceiver 13 or transceiver means can use a suitable universal mobile telecommunications system (UMTS) protocol or GSM, a wireless local area network (WLAN) protocol such as for example IEEE 802.X, a suitable short-range radio frequency communication protocol such as Bluetooth, or infrared data communication pathway (IRDA).

It is to be understood again that the structure of the electronic device 10 could be supplemented and varied in many ways.

As described herein the concept of the embodiments described herein is the ability to implement directional/positional robust audio signal processing using at least three microphone inputs.

Figure 3:
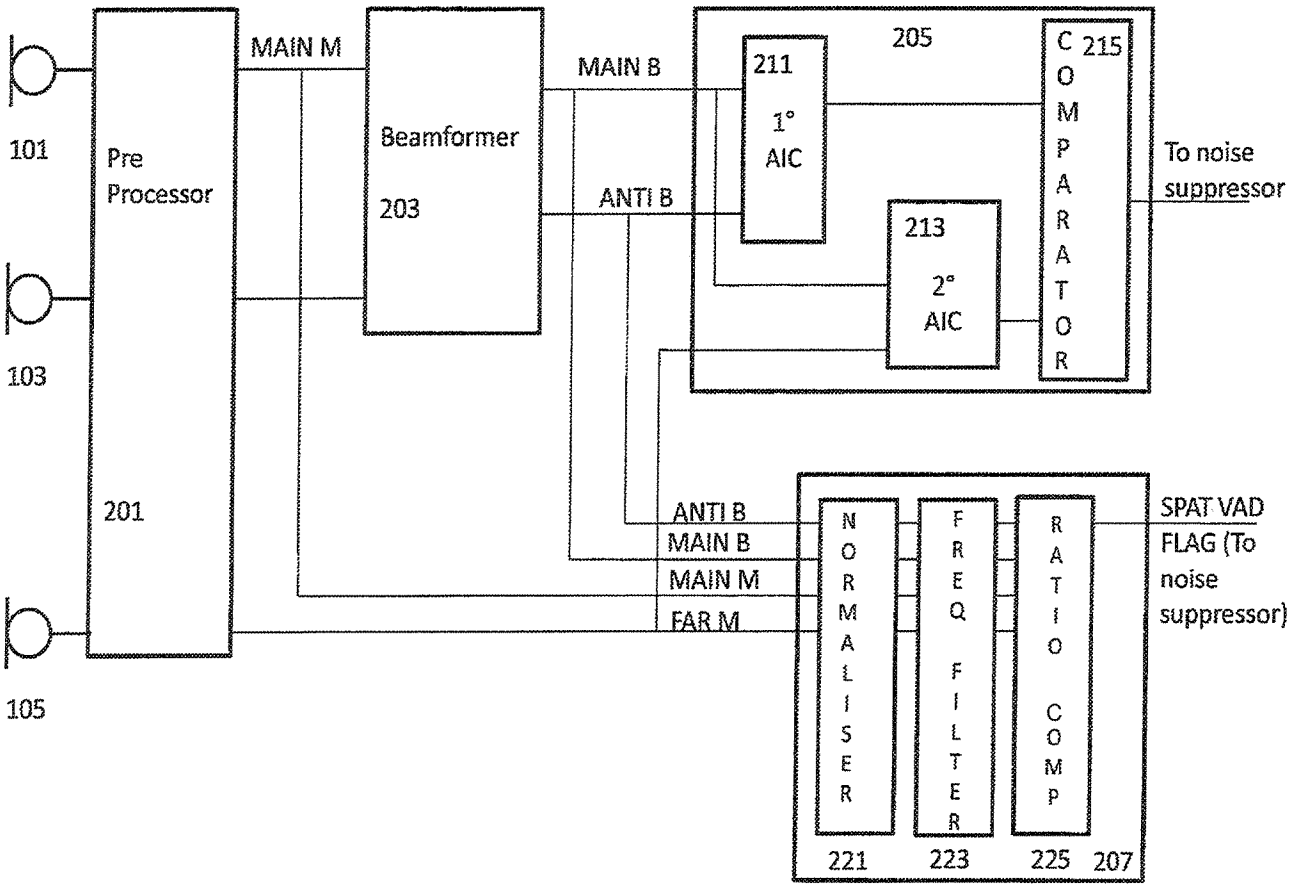
FIG. 3 shows schematically a signal processor for a multi-microphone system according to some embodiments.

With respect to FIG. 3 an example audio signal processor apparatus is shown according to some embodiments. With respect to FIG. 4 the operation of the audio signal processing apparatus shown in FIG. 3 is described in further detail.

The audio signal processor apparatus in some embodiments comprises a pre-processor 201. The pre-processor 201 can be configured to receive the audio signals from the microphones, shown in FIG. 3 as the near microphones 103, 105 and the far microphone 101. The location of the near and far microphones can be as shown in the example configuration as shown in FIG. 2, however it would be understood that in some embodiments that other configurations and/or numbers of microphones can be used.

Although the embodiments as described herein feature audio signals received directly from the microphones as the input signals it would be understood that in some embodiments the input audio signals can be pre-stored or stored audio signals. For example in some embodiments the input audio signals are audio signals retrieved from memory. These retrieved audio signals can in some embodiments be recorded microphone audio signals.

Figure 4:
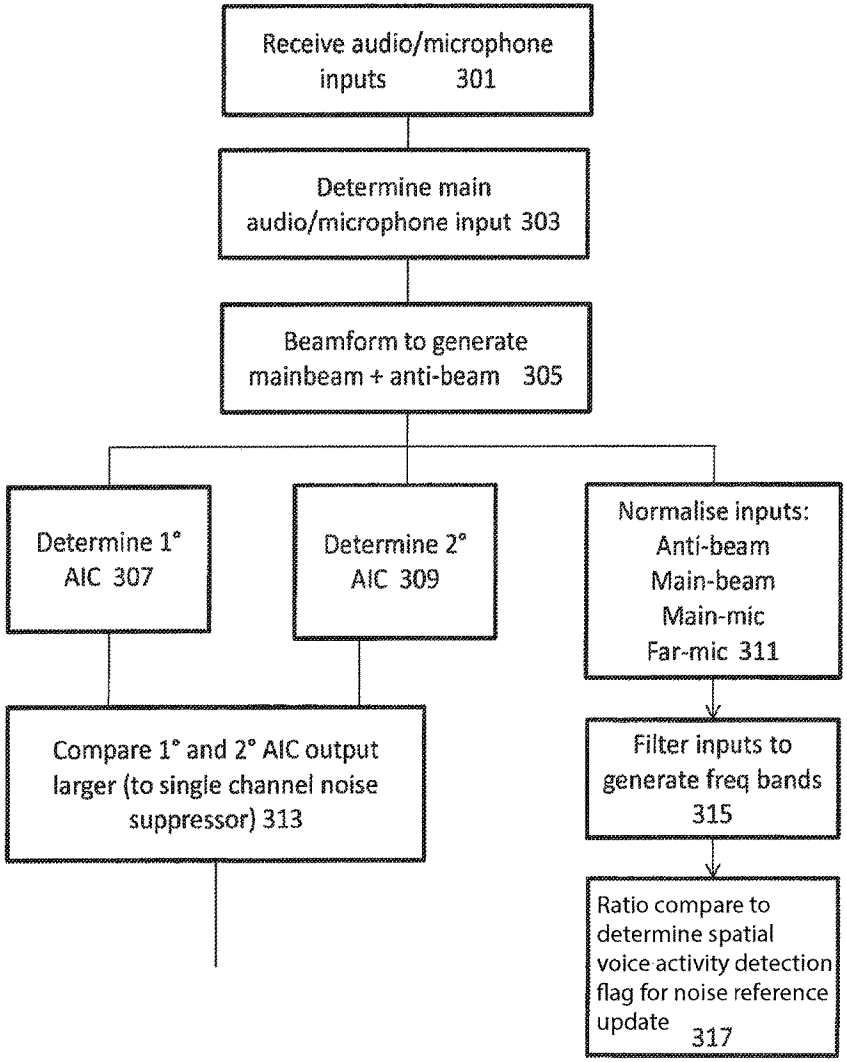
FIG. 4 shows schematically a flow diagram of the operation of the signal processor for the multi-microphone system as shown in FIG. 3 according to some embodiments.

The operation of receiving the audio/microphone input is shown in FIG. 4 by step 301.

The pre-processor 201 can in some embodiments be configured to perform any suitable pre-processing operation. For example in some embodiments the pro-processor can be configured to perform operation such as: to calibrate the microphone audio signals; to determine whether the microphones are free from any impairment; to correct the audio signals where impairment is determined; to determine whether any of the microphones are operating in strong wind; and to determine which of the microphone inputs is the main microphone. For example in some embodiments the microphones can be compared to determine which has the loudest input signal and is therefore determined to be directed towards the user. In the example shown herein the near microphone 103 is determined to be the main microphone and therefore the output of the pre-processor determines the main microphone output as the near microphone 103 input audio signal.

The operation of pre-processing such as a determination of the main microphone input is shown in FIG. 4 by step 303.

In some embodiments the main microphone audio signal and other determined near microphone audio signals can then be passed to the beamformer 203.

In some embodiments the audio signal processor comprises a beamformer 203. The beamformer 203 can be configured to receive the near microphone inputs, such as shown in FIG. 3 by the main microphone (MAINM) coupling and the other near microphone coupling from the pre-processor. The beamformer 203 can then be configured to generate at least two beam audiosignals. For example as shown in FIG. 3 the beamformer 203 can be configured to generate a main beam (MAINB) and anti-beam (ANTIB) audio signals.

The beamformer 203 can be configured to generate any suitable beamformed audio signal from the main microphone and other near microphone inputs. As described herein in some embodiments the main beam audio signal is one where the local speech is substantially passed without processing while the noise coming from the opposite direction is substantially attenuated, and the anti-beam audio signal is one where the local speech is heavily attenuated or substantially attenuated while the noise from the other directions is not attenuated.

The beamformer 203 can in some embodiments be configured to output the beam audio signals, for example, the main beam and the anti-beam audio signals, to the adaptive interference canceller (AIC) 205 and to the spatial voice activity detector 207.

In some embodiments the beamformer operates in the time domain and employs finite impulse response (FIR) filters to attenuate some directions.

It would be understood that in embodiments with two nearmics and one farmic there are altogether four FIR filters. (Though it would be understood that in some embodiments other kinds of processing could be implemented). The four FIR filters can for example be employed in the following way:

1. Mainbeam employs two FIR filters, a first FIR for the first nearmic audio signal and a second FIR for the second nearmic audio signal. These filtered signals are then combined.
2. Antibeam employs another two FIR filters, the third FIR for first nearmic audio signal and a fourth FIR for the second nearmic audio signal. These filtered signals are then combined.
3. Farmic: no processing in the beamformer The operation of beamforming the near microphone audio signals to generate a main beam and anti-beam audio signals is shown in FIG. 4 by step 305.

In some embodiments the audio processor comprises an adaptive interference canceller (AIC) 205. The adaptive interference canceller (AIC) 205, in some embodiments, comprises at least two audio interference canceller modules. Each of the audio canceller modules are configured to provide a suitable audio processing output for various combination of microphones inputs.

In some embodiments the audio interference canceller 205 comprises a primary (or first or main) audio interference canceller (AIC) module 211, a secondary (or secondary) AIC module 213 and a comparator 215 configured to receive the outputs of the primary AIC module 211 and the secondary AIC module 213.

The primary audio interference canceller module 211 can be configured to receive the audio signals from the main beam and anti-beam audio signals and determine a first audio interference canceller module output using the main beam as a speech and noise input and the anti-beam as a noise reference and 'leaked' speech input. The primary audio interference canceller module 211 can be configured to then pass the processed module output to a comparator 215.

The operation of determining a first adaptive interference cancellation output is shown in FIG. 4 by step 307.

The secondary AIC module 213 is configured to receive as inputs the main beam audio signal and the far microphone audio signal (in other words the audio information from all three microphones). The secondary AIC module 213 can be configured to generate an adaptive interference cancellation output using the main beam audio signal as a speech and noise input and the far microphone audio signal as a noise reference and 'leaked' speech input The secondary audio interference canceller module 213 can then be configured to output a secondary adaptive interference cancellation output to the comparator 215.

The operation of determining a secondary AIC module output is shown in FIG. 4 by step 309.

The adaptive interference canceller 205 as described herein further comprises a comparator 215 configured to receive the outputs of the at least two AIC modules. In FIG. 3 these AIC module outputs are the primary AIC module 211 and the secondary AIC module 213, however it would be understood that in some embodiments any number of AIC modules can be used and therefore the comparator 215 receive any number of module signals. The comparator 215 can then be configured to compare the AIC module outputs and output the one which has the highest output signal level.

In some embodiments the comparator 215 can furthermore be configured to have a preferred or default output and only switch to a different module output where there is a considerable difference. For example the comparator 215 can be configured to determine whether the signal level difference between two AIC modules is greater than a threshold value (for example 2 dB) and only switch when the threshold value is passed. For example in some embodiments the comparator 215 can be configured to output the primary AIC module 211 output while the primary AIC module output is equal to or greater than the secondary AIC module output and only switch to the secondary AIC module output when the secondary AIC module output 213 is 2 dB greater than the primary AIC module output.

The operation of comparing the primary and secondary AIC outputs and outputting the larger is shown in FIG. 4 by step 313.

Figure 7:
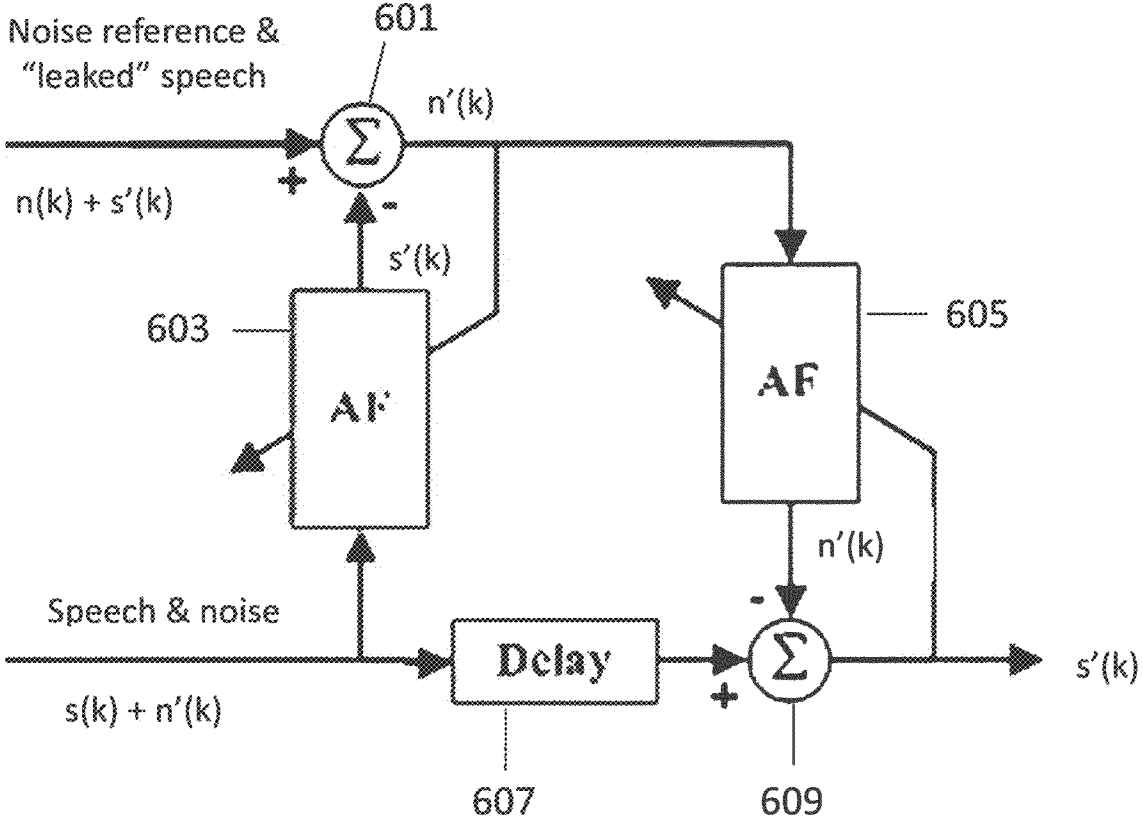
FIG. 7 shows an example adaptive interference canceller according to some embodiments.

The AIC 205 which as shown in this example comprises two parallel AIC modules operates in the time domain employing adaptive filters such as shown herein in FIG. 7. However any suitable implementation can be employed in some embodiments such as series or hybrid series-parallel AIC implementations.

In some embodiments the AIC 205 can be configured to receive control inputs. These control inputs can be used to control the behaviour of the AIC based on environmental factors such as determining whether the microphone is operating in wind (and therefore at least one microphone is generating large amounts of wind noise) or operating in a wind shadow. Furthermore in some embodiments the audio processor is configured to be optimised for speech processing and thus a voice activity detection process occurs in order that the audio interference canceller operates to optimise voice signal to background noise. It would be understood that in some embodiments the inputs to the AIC modules are normalised.

In some embodiments the AIC output can be passed to a single channel noise suppressor. A single channel noise suppressor is a known component which based on a noise estimate can perform further noise suppression. The single noise suppressor and the operation of the single channel noise suppressor is not described in further detail here but it would be understood that the single channel noise suppressor receives an input of a noisy speech signal, and from the noisy speech signal estimates the background noise. The estimate of the background noise being then used to improve the noisy speech signal, for example by applying a Weiner filter or other known method). The estimate of the noise is made from the noisy speech signal when the noisy speech signal is determined to be noise only for example based on an output from a voice activity detector and/or as described herein a spatial voice activity detector (spatial VAD). The single channel noise suppressor typically operates within the frequency domain, however it would be understood that in some embodiments a time domain single channel noise suppressor could be employed.

The single channel noise suppressor can thus use the spatial VAD information to attenuate non-stationary background noise such as babble, clicks, radio, competing speakers, and children that try to get your attention during phone calls.

Thus for example the audio processor in some embodiments can comprise a spatial voice activity detector 207. The spatial voice activity detector 207 can in some embodiments be configured to receive as inputs the main beam, anti-beam, main microphone and far microphone audio signals. The operation of the spatial voice activity detector is to force the single channel noise suppressor to only update the noise estimate when the audio signal comprises noise (or in other words to not update the noise estimate when the audio signal comprises speech from the expected direction)

In some embodiments the spatial voice security detector 207 comprises a normaliser 221. The normaliser 221 can in some embodiments be configured to receive the main microphone, the far microphone, the main beam and anti-beam audio signals and perform a normalisation process on these audio signals. The normalisation process is performed such that levels of the audio signals during the stationary noise are substantially the same. This normalisation process is performed in order to prevent any bias due to microphone sensitivity variations or beam sensitivity variations.

In some embodiments the normaliser is configured to perform a smoothed signal minima determination on the audio signals. In such embodiments the normaliser can then determine a ratio between the minima of the inputs to determine a normalisation gain factor to be applied to each input to normalise the stationary noise. In some embodiments the normaliser can further be configured to determine spatial stationary noise (for example road on one side and forest on the other side of the apparatus) and in such embodiments adapt the normalisation to the noise levels and prevent the marking of the noise as speech. Similar or same normalization can be carried out for controlling adaptive filtering blocks in the AIC 205. As such in some embodiments a common normaliser can be employed for both the AIC (and therefore in some embodiments the AIC modules) and the spatial VAD such that the AIC modules and the spatial VAD receives inputs of normalised audio inputs.

In some embodiments the Nearmics audio signals are calibrated prior to any processing, for example beamforming, (such that only small differences in mic sensitivities are allowed) in order to have proper beams that point where they should (in these examples towards a user's mouth and in the opposite direction).

It would be understood that the Noise level in the mainbeam audio signal is typically lower than the farmic audio signal, because beamforming reduces background noise.

Before comparing signal levels for spatial VAD and AIC's internal control these signals have to be normalized. This normalisation can be performed after beamforming Furthermore it would be understood that whilst Noise levels in mainbeam and antibeam audio signals are the same for ambient noise (for example inside a car), the noise levels would not necessarily be the same for directional stationary noise (for example when a user is standing on one side of a street). Therefore in some embodiments the mainbeam and antibeam audio signals have to be normalized after beamforming for spatial VAD and AIC's internal control.

Noiselevels in the first nearmic and farmic audio signals are generally approximately the same, but since these signals need not to be calibrated against microphone sensitivity differences in some embodiments the first nearmic and farmic audio signals are normalized for spatial VAD (They are not used in AIC as an input signal pair in the examples shown herein).

The operation of normalising the inputs is shown in FIG. 4 by step 311.

In some embodiments the spatial voice activity detector 207 comprises a frequency filter 223. The frequency filter 223 can be configured to receive the normalised audio signal inputs and frequency filter the audio signals. In some embodiments the microphone and/or beamformed audio signals signals (such as the main microphone, and far microphone audio signals are low pass frequency filtered. In some embodiments the microphone signals (or beamformed audio signals) main beam—'farmic' comparison and also to the main microphone (first nearmic)—farmic comparison (in other words the comparison of the microphone signals) can implement a low pass filter with a pass band of e.g. about 0-800 Hz. The beam audio signals, for example the main beam and the anti-beam audio signals are also frequency filtered. The frequency filtering of the beam audio signals can be determined based on the beam design of the beamformer 203. This is because the beams are designed so that the greatest separation is over a certain frequency range. An example of the frequency pass band for the main beam and anti-beam audio signals comparison would be approximately 500 Hz to 2500 Hz. The filtered audio signals can then be passed to a ratio comparator 225.

The operation of filtering the inputs to generate frequency bands is shown in FIG. 4 by step 315.

In some embodiments the spatial voice activity detector 207 comprises a ratio comparator 225. The ratio comparator 225 can be configured to receive the frequency filtered normalised audio signals and generate comparison pairs to determine whether the audio signals comprise spatially orientated voice information. In some embodiments the comparison pairs are:

The main beam and anti-beam normalised filtered (e.g. 500-2500 Hz) audio signal levels The near microphone and far microphone normalised filtered (e.g. 0-800 Hz) audio signal levels The main beam and far microphone normalised filtered (e.g. 0-800 Hz) audio signal levels Where the comparison of the pair produces a ratio is greater than a determined threshold value for any of the comparisons then there is determined to be significant voice activity in a spatial direction. In other words only where the signal level is the same for microphones and beams is it determined that audio signals are background noise.

In such a way speech can be detected even when the positioning of the apparatus is not optimal.

The operation of ratio comparing to determine a spatial voice activity detection flag (for noise reference updates) is shown in FIG. 4 by step 317.

In some embodiments the spatial VAD 207 output can be employed as a control input to a single channel noise suppressor as discussed herein or other suitable noise suppressor such that when the spatial VAD 207 determines that each of the ratios is similar or substantially similar then the single channel noise suppressor or other suitable noise suppressor can use the background noise estimate whereas where the signal level differs between any of the comparisons then the background noise estimate is not used (and in some embodiments an older estimate is used.

Figure 6:
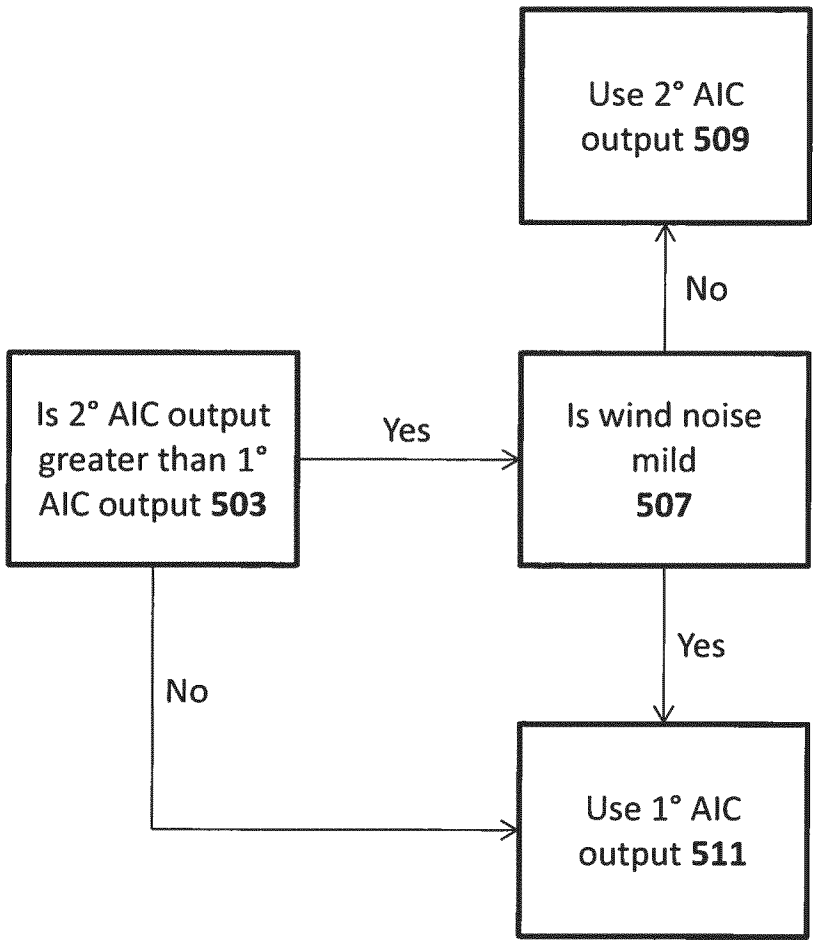
FIG. 6 shows schematically an example flow diagram of the operation of the signal processor based on a control input according to some embodiments.

With respect to FIG. 6 an example flow diagram showing the operation of the audio processor, and especially the AIC, based on control inputs as described herein is shown in further detail.

The AIC and specifically in the embodiments described herein determines whether the secondary AIC output is stronger than the primary AIC output.

The operation of determining whether the secondary AIC output is stronger than the primary AIC output is shown in FIG. 6 by step 503.

Where the secondary AIC output is stronger than the primary AIC output then a further test of whether the system is operating in mild wind is determined.

The operation of determining whether the system is operating in mild wind is shown in FIG. 6 step 507.

Where the system is not operating in mild wind then the three microphone processing operation is used, in other words the secondary AIC is output by the comparator.

The operation of using the secondary AIC (three microphone) processing output is shown in FIG. 6 by step 509.

Where the system is operating in mild wind or the secondary AIC output is not stronger than the primary AIC output then the primary AIC output is used.

The use of the primary AIC output is shown in FIG. 6 by step 511.

Furthermore with respect to FIG. 7 an example AIC is used wherein a first microphone or beam for the noise reference and leaked speech is passed as a positive input to a first adder 601. The first adder 601 outputs to a first adaptive filter 603 control input and to a second adaptive filter 605 data input. The first adder 601 further receives as a negative input the output of the first adaptive filter 603. The first adaptive filter 603 receives as a data input the speech and noise microphone or beam audio signal. The speech and noise microphone or beam audio signal is further passed to a delay 607. The output of the delay 607 is passed as a positive input to a second adder 609. The second adder 609 receives as a negative input the output of the second adaptive filter 605. The output of the second adder 609 is then output as the signal output and used as the control input to the second adaptive filter 605.

In such a manner the Wiener filtering operates as a suppression method that can be carried out to single channel audio signal s(k). Although the example shown in FIG. 7 would appear to allow the AIC to remove all noise, this is not achieved in practical situations as typically there is output background noise that is further reduced in some embodiments by the single channel noise suppressor.

In other words FIG. 7 shows an example AIC module comprising two adaptive filters: a speech reduction AF (configured to reduce leaked speech from the secondary input=noise+leaked speech) and a noise reduction AF (configured to reduces noise from primary input=speech+noise). Although in this embodiment shown there is a double adaptive filtering structure configured to provide better position robustness by reducing Leaked speech from secondary input before it is used in noise reduction AF as a noise reference it would be understood that any suitable filter and filtering may be applied.

It shall be appreciated that the electronic device 10 may be any device incorporating an audio recordal system for example a type of wireless user equipment, such as mobile telephones, portable data processing devices or portable web browsers, as well as wearable devices.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

receiving at least three microphone audio signals from at least three microphones, the at least three microphones located on or coupled to an apparatus;

determining which of the at least three microphone audio signals is from a main microphone of the at least three microphones, where the main microphone comprises a first near microphone of the at least three microphones located near to a desired audio source;

generating a beam audio signal based on a filtering of a first near microphone audio signal of the at least three microphone audio signals from the first near microphone and a second near microphone audio signal of the at least three microphone audio signals from a second near microphone of the at least three microphones;

generating an anti-beam audio signal based on a different filtering of the first near microphone audio signal and the second near microphone audio signal;

generating a first audio interference cancellation output signal based on the beam audio signal and the anti-beam audio signal;

generating a second audio interference cancellation output signal based on the beam audio signal and a input third microphone audio signal of the at least three microphone audio signals from a far microphone of the at least three microphones located further from the desired audio source than the first near microphone and the second near microphone;

comparing levels of the first audio interference cancellation output signal and the second audio interference cancellation output signal; and providing a highest output signal of the first audio interference cancellation output signal and the second audio interference cancellation output signal based on the comparing of the levels.

2. The method as claimed in claim 1, wherein receiving the at least three microphone audio signals comprises:

receiving one of the first near microphone audio signal or the second near microphone audio signal from a front microphone of the at least three microphones located substantially at a front of the apparatus;

receiving one of the first near microphone audio signal or the second near microphone audio signal from a back microphone of the at least three microphones located substantially at a rear of the apparatus; and receiving the third microphone audio signal from the far microphone located substantially at an opposite end of the apparatus from the front and back microphones, wherein either the front microphone or the back microphone is determined to be the main microphone which comprises the first near microphone located near to the desired audio source.

3. The method as claimed in claim 2, where generating the beam audio signal comprises:

applying a first finite impulse response filter to the first near microphone audio signal;

applying a second finite impulse response filter to the second near microphone audio signal; and combining output of the first finite impulse response filter and the second finite impulse response filter to generate the beam audio signal.

4. The method as claimed in claim 3, where generating the anti-beam audio signal comprises:

applying a third finite impulse response filter to the first near microphone audio signal;

applying a fourth finite impulse response filter to the second near microphone audio signal; and combining output of the third finite impulse response filter and the fourth finite impulse response filter to generate the anti-beam audio signal.

5. The method as claimed in claim 2, wherein generating the second audio interference cancellation output signal comprises filtering the beam audio signal based on the third microphone audio signal.

6. The method as claimed in claim 2, wherein generating the first audio interference cancellation output signal comprises filtering the beam audio signal based on the anti-beam audio signal.

7. The method as claimed in claim 1, further comprising filtering the beam audio signal based on the third microphone audio signal to generate the second audio interference cancellation output signal.

8. The method as claimed in claim 7, wherein filtering the beam audio signal based on the third microphone audio signal comprises noise suppression filtering of the beam audio signal based on the third microphone audio signal.

9. The method as claimed in claim 1, further comprising single channel noise suppressing the highest output signal, wherein the single channel noise suppressing comprises:

generating an indicator showing a period of the highest output signal comprises a lack of speech components or is significantly noise;

estimating and updating a background noise value from the highest output signal based on the indicator; and processing the highest output signal based on the estimated background noise value to generate a noise suppressed audio signal.

10. The method as claimed in claim 9, wherein generating the indicator comprises:

normalising selections from the at least three microphone audio signals, wherein the selections comprise:

the beam audio signal and the anti-beam audio signal; and the at least three microphone audio signals;

filtering the normalised selections from the at least three microphone audio signals;

comparing the filtered normalised selections to determine a power difference ratio; and generating the indicator where at least one comparison of the filtered normalised selections has a power difference ratio greater than a determined threshold.

11. The method as claimed in claim 1, further comprising:

determining whether any of the at least three microphones are impaired; and correcting any of the at least three microphone audio signals where impairment is determined.

12. The method as claimed in claim 1, wherein determining which of the at least three microphones is the main microphone which comprises the first near microphone comprises determining which of the at least three microphone audio signals is loudest and determining a microphone of the at least three microphones associated with the determined loudest microphone audio signal is the main microphone and is directed towards the desired audio source.

13. The method as claimed in claim 1, wherein the desired audio source is local speech and wherein generating the beam and anti-beam audio signals comprises:

generating the beam audio signal wherein the local speech, with respect to the main microphone which comprises the first near microphone, is substantially passed while noise coming from an opposite direction is significantly attenuated; and generating the anti-beam audio signal wherein the local speech, with respect to the main microphone which comprises the first near microphone, is substantially attenuated while noise from other directions is substantially passed.

14. The method as claimed in claim 1, wherein generating the first audio interference cancellation output signal comprises generating the first audio interference cancellation output signal based on:

the beam audio signal as a signal comprising local speech, with respect to the main microphone which comprises the first near microphone, which is substantially passed while noise coming from an opposite direction is significantly attenuated, and the anti-beam audio signal as a signal comprising the local speech, with respect to the main microphone which comprises the first near microphone, which is substantially attenuated while noise from other directions is substantially passed.

15. The method as claimed in claim 14, wherein generating the second audio interference cancellation output signal comprises generating the second audio interference cancellation output signal based on:

the beam audio signal as a signal comprising local speech, with respect to the main microphone which comprises the first near microphone, which is substantially passed while noise coming from an opposite direction is significantly attenuated, and the third microphone audio signal as a signal comprising the local speech which is substantially attenuated while noise from other directions is substantially passed.

16. An apparatus comprising at least one processor and at least one non-transitory memory including computer code for one or more programs, the at least one non-transitory memory and the computer code configured to with the at least one processor cause the apparatus to:

receive at least three microphone audio signals from at least three microphones, the at least three microphones located on or coupled to the apparatus;

determine which of the at least three microphone audio signals is from a main microphone of the at least three microphones, where the main microphone comprises a first near microphone of the at least three microphones located near to a desired audio source;

generate a beam audio signal based on a filtering of a first near microphone audio signal of the at least three microphone audio signals from the first near microphone and a second near microphone audio signal of the at least three microphone audio signals from a second near microphone of the at least three microphones;

generating an anti-beam audio signal based on a different filtering of the first near microphone audio signal and the second near microphone audio signal;

generate a first audio interference cancellation output signal based on the beam audio signal and the anti-beam audio signal;

generate a second audio interference cancellation output signal based on the beam audio signal and a third microphone audio signal of the at least three microphone audio signals from a far microphone of the at least three microphones located further from the desired audio source than the first near microphone and the second near microphone;

compare levels of the first audio interference cancellation output signal and the second audio interference cancellation output signal; and provide a selected output signal of the first audio interference cancellation output signal and the second audio interference cancellation output signal based on comparing the levels, where the selected output signal is one of:

a default output signal selected from the first audio interference cancellation output signal and the second audio interference cancellation output signal, or a highest output signal of the first audio interference cancellation output signal and the second audio interference cancellation output signal.

17. The apparatus as claimed in claim 16, wherein the default output signal comprises the first audio interference cancellation output signal, and when providing the selected output signal, the at least one non-transitory memory and the computer code are further configured to with the at least one processor cause the apparatus to provide as the selected output signal the highest output signal comprising the second audio interference cancellation output signal where a level difference between the first audio interference cancellation output signal and the second audio interference cancellation output signal is greater than a threshold value.

18. The apparatus as claimed in claim 17, wherein the threshold value comprises a predetermined decibel level.

19. The apparatus as claimed in claim 16, wherein the at least one non-transitory memory and the computer code are further configured to with the at least one processor cause the apparatus to:

determine whether any of the at least three microphones are operating in mild wind, wherein providing the selected output signal further comprises providing the first audio interference cancellation output signal or the second audio interference cancellation output signal based on the determination.

20. The apparatus as claimed in claim 16, wherein the at least one non-transitory memory and the computer code are further configured to with the at least one processor cause the apparatus to:

determine whether any of the at least three microphones are operating in strong wind and/or wind shadow, wherein providing the selected output signal further comprises providing the first audio interference cancellation output signal or the second audio interference cancellation output signal based on the determination.

21. The apparatus as claimed in claim 16, wherein receiving the at least three microphone audio signals comprises:

receiving the first near microphone audio signal from the first near microphone located substantially at a front of the apparatus;

receiving the second near microphone audio signal from the second near microphone located substantially at a rear of the apparatus; and receiving the third microphone audio signal from the far microphone located substantially at an opposite end of the apparatus from the first and second near microphones.

22. The apparatus as claimed in claim 16, wherein the at least one non-transitory memory and the computer code are further configured to with the at least one processor cause the apparatus to:

generate the beam audio signal, where generating the beam audio signal comprises:

applying a first finite impulse response filter to the first near microphone audio signal;

applying a second finite impulse response filter to the second near microphone audio signal; and combining output of the first finite impulse response filter and the second finite impulse response filter to generate the beam audio signal; and generate the anti-beam audio signal, where generating the anti-beam audio signal comprises:

applying a third finite impulse response filter to the first near microphone audio signal;

applying a fourth finite impulse response filter to the second near microphone audio signal; and combining output of the third finite impulse response filter and the fourth finite impulse response filter to generate the anti-beam audio signal.

23. The apparatus as claimed in claim 16, wherein the at least one non-transitory memory and the computer code are further configured to with the at least one processor cause the apparatus to single channel noise suppress the selected output signal, wherein single channel noise suppressing the selected output signal comprises:

determining a period of the selected output signal comprises a lack of speech components or is significantly noise;

estimating and updating a background noise value from the selected output signal based on the determined period; and processing the selected output signal based on the estimated background noise value to generate a noise suppressed audio signal.

24. The apparatus as claimed in claim 23, wherein determining the period comprises:

normalising selections from the at least three microphone audio signals, wherein the selections comprise:

the beam audio signal and the anti-beam audio signal; and the at least three microphone audio signals;

filtering the normalised selections from the at least three microphone audio signals;

comparing the filtered normalised selections to determine a power difference ratio; and determining the period where at least one comparison of the filtered normalised selections has a power difference ratio greater than a determined threshold.

* * * * *